US006652739B2

(12) United States Patent
Jacobson et al.

(10) Patent No.: US 6,652,739 B2
(45) Date of Patent: Nov. 25, 2003

(54) PROCESS FOR DEASPHALTING RESIDUA BY REACTIVE RECYCLE OF HIGH BOILING MATERIAL

(75) Inventors: Mitchell Jacobson, Fairfax, VA (US); Willibald Serrand, Buxheim (DE); Norman H. Sweed, Berkeley Heights, NJ (US); Hans J. M. Weiss, Oberursel (DE); Ingo W. Dreher, Oberursel (DE); Udo Zentner, Griesheim (DE); Jorg H. Schmalfeld, Bad Homburg (DE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/283,387

(22) Filed: Oct. 29, 2002

(65) Prior Publication Data

US 2003/0121828 A1 Jul. 3, 2003

Related U.S. Application Data

(63) Continuation-in-part of application No. 09/712,751, filed on Nov. 14, 2000, now abandoned, which is a continuation-in-part of application No. 09/293,029, filed on Apr. 16, 1999, now abandoned.

(51) Int. Cl.[7] ..... C10C 3/02; C10C 3/00
(52) U.S. Cl. ..... 208/309; 208/39; 208/40
(58) Field of Search ..... 208/309, 39, 40

(56) References Cited

U.S. PATENT DOCUMENTS

| | | | | |
|---|---|---|---|---|
| 3,334,043 A | 8/1967 | Ferris et al. | ..... | 208/309 |
| 4,054,513 A | 10/1977 | Windle | ..... | 209/214 |
| 4,191,639 A | 3/1980 | Audeh et al. | ..... | 208/309 |
| 4,485,136 A | 11/1984 | Koch et al. | ..... | 428/36 |
| 4,749,470 A | 6/1988 | Herbst et al. | ..... | 208/85 |
| 5,501,789 A | 3/1996 | Bartholic | ..... | 208/127 |
| 5,714,056 A | 2/1998 | Hammond et al. | ..... | 208/127 |
| 5,714,663 A | 2/1998 | Serrand et al. | ..... | 585/648 |

*Primary Examiner*—Thuan D. Dang
(74) *Attorney, Agent, or Firm*—Erika Singleton Wilson

(57) ABSTRACT

An improved process for deasphalting a residua feedstock by use of a short vapor residence time process unit comprised of a horizontal moving bed of fluidized and/or stirred hot particles. The vapor phase product stream from said process unit is passed to a soaker drum where a high boiling fraction is separated and recycled to the process unit after undergoing reactions causing molecular weight growth. This reactive recycle using the soaker drum results in substantially improved qualities of the liquid products compared with what is achieved by once-through residua deasphalting process alternatives.

16 Claims, 1 Drawing Sheet

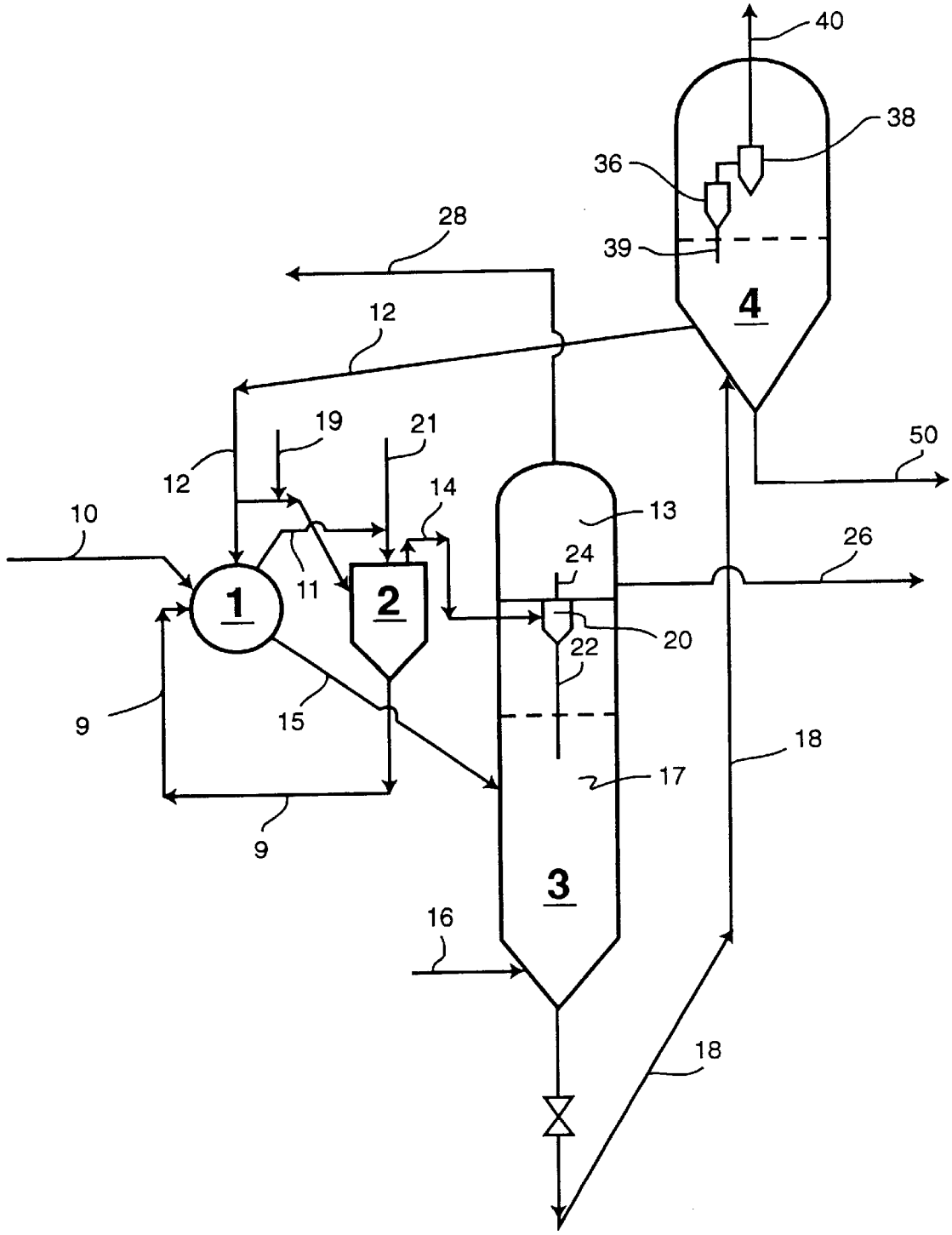
40
38
36
39
28
4
12
12
19
21
50
14
13
10
24
26
1
11
2
20
22
9
15
18
17
9
3
16
18

PROCESS FOR DEASPHALTING RESIDUA BY REACTIVE RECYCLE OF HIGH BOILING MATERIAL

CROSS-REFERENCE TO RELATED APPLICATIONS

This application is a continuation-in-part of U.S. patent application Ser. No. 09/712,751 filed Nov. 14, 2000 now abandoned, which is a continuation-in-part of U.S. patent application Ser. No. 09/293,029 filed Apr. 16, 1999 now abandoned.

FIELD OF THE INVENTION

The present invention relates to an improved process for deasphalting a residua feedstock by use of a short vapor residence time process unit comprised of a horizontal moving bed of fluidized and/or stirred hot particles. The vapor phase product stream from said process unit is passed to a soaker drum where a high boiling fraction is separated and recycled to the process unit after undergoing reactions causing molecular weight growth. This reactive recycle using the soaker drum results in substantially improved qualities of the liquid products compared with what is achieved by once-through residua deasphalting process alternatives.

BACKGROUND OF THE INVENTION

In a typical refinery, crude oils are subjected to atmospheric distillation to separate lighter materials such as gas oils, kerosenes, gasolines, straight run naphtha, etc. from the heavier materials. The residue from the atmospheric distillation step is then distilled at a pressure below atmospheric pressure. This later distillation step produces a vacuum gas oil distillate and a vacuum reduced residual oil that often contains relatively high levels of asphaltene molecules. These asphaltene molecules usually contain most of the Conradson Carbon residue and metal components of the resid. They also contain relatively high levels of heteroatoms, such as sulfur and nitrogen. Such feeds have little commercial value, primarily because they cannot be used as a fuel oil because of ever stricter environmental regulations. They also have little value as feedstocks for refinery processes, such as fluid catalytic cracking, because they produce excessive amounts of gas and coke. Also, their high metals content leads to catalyst deactivation. Thus, there is a great need in petroleum refining to upgrade residual feeds to more valuable cleaner and lighter feeds.

There are a number of techniques used for recovering the lighter components from various asphaltic petroleum residual feeds. Many such processes involve the extraction of the lighter components with a deasphalting solvent such as propane, and thereafter separating and recovering the lighter components from the solvent. In U.S. Pat. No. 2,950,244, a process for the extraction of petroleum residue containing asphalt is disclosed. The solvent utilized is a liquefied normally gaseous solvent, such a propane, which is maintained at a temperature between about 100° F. and 200° F. and at a pressure sufficient to maintain the solvent in a liquid phase.

Variations of the deasphalting process using propane, or similar short chain aliphatics as solvents, are taught in U.S. Pat. No. 2,669,538 to Yuraski et al.; U.S. Pat. No. 3,516,928 to King et al. issued Jun. 23, 1970; U.S. Pat. No. 4,017,383 to Beavon, issued Apr. 12, 1977; and U.S. Pat. No. 4,201,660 to Szosel, issued May 6, 1980. King et al. additionally suggest that carbon dioxide and ammonia, under certain circumstances are equivalent solvents to the lower alkanes, alkenes, and their halogenated derivatives.

While propane is often used in conventional solvent deasphalting operations, other solvents have been suggested. For example, in U.S. Pat. No. 4,054,512, an asphalt-containing mineral oil is deasphalted by contacting the oil with liquid hydrogen sulfide. The use of liquid neopentane, at a temperature between 0° F. and 250° F., taught in U.S. Pat. No. 3,334,043. Also, in U.S. Pat. No. 2,337,448, heavy residual oil is deasphalted by a solvent selected from the group consisting of ethane, ethylene, propane, propylene, butane, butylene, isobutane, and mixtures thereof.

U.S. Pat. No. 4,191,639 to Audeh et al teaches a process wherein hydrocarbon oils, such as residual petroleum oils, are deasphalted and demetallized by contact with a liquid mixture of at least two of the components selected from hydrogen sulfide, carbon dioxide, and propane.

Also, U.S. Pat. No. 5,714,056 teaches a process for deasphalting residua in a short vapor contact time thermal process unit comprised of a horizontal moving bed of fluidized hot particles. This is a once through process whereby the removal of feed contaminants is limited to what can be achieved in a single pass. There is no suggestion of separating a high boiling fraction from the vapor product fraction and recycling it to the reaction zone.

While solvent deasphalting has met with commercial success, there is nevertheless a continuing need in the art for deasphalting processes which result in higher liquid yields and improved liquid product quality than solvent deasphalting. There is also a need in the art for improved processes capable of deasphalting an asphalt-containing residual feedstock without the use of a solvent.

SUMMARY OF THE INVENTION

In accordance with the present invention there is provided a process for deasphalting an asphalt-containing feedstock in a deasphalting process unit comprised of:

(i) a heating zone wherein solids containing carbonaceous deposits are received from a stripping zone and heated in the presence of a heating gas which may contain oxygen for partial combustion purposes;

(ii) a short vapor residence time reaction zone containing a horizontal moving bed of fluidized and/or stirred hot solids recycled from the heating zone and feed, which reaction zone is operated at a temperature from about 450° C. to about 700° C. and operated under conditions such that the solids residence time and the vapor residence time are independently controlled, which vapor residence time is less than about 5 seconds, and which solids residence is from about 5 to about 60 seconds; and (iii) a stripping zone through which solids having carbonaceous deposits thereon are passed from the reaction zone and wherein lower boiling additional hydrocarbon and volatiles are recovered with a stripping gas; which process comprises:

(a) feeding the residua feedstock to the short vapor residence time reaction zone wherein it contacts the hot solids thereby resulting in high Conradson Carbon components and metal-containing components being deposited onto said hot solids, and a vaporized fraction;

(b) separating the vaporized fraction from the solids; and (c) passing the solids to said stripping zone where they are contacted with a stripping gas, thereby removing volatile components therefrom;

(d) passing the stripped solids to a heating zone where they are heated to an effective temperature that will maintain the operating temperature of the reaction zone;

(e) recycling hot solids from the heating zone to the reaction zone where they are contacted with fresh feedstock;

(f) passing the vaporized fraction from step (b) above to a soaker drum where it is quenched to produce a vapor fraction boiling less than about 450–600° C. and a high boiling fraction condensate having an initial boiling point in the range of about 450–600° C.;

(g) providing sufficient residence time and reactor severity in the soaker drum to permit molecular weight growth reactions to occur; (h) recycling said high boiling fraction to the short vapor contact time reaction zone; and (i) recovering the vapor fraction having a lower concentration of contaminants from step (h).

In a preferred embodiment of the present invention, steam, $C_4$ minus gas, or both, is injected into the soaker drum to maintain the solids in suspension and to strip out lower boiling range products.

In another preferred embodiment of the present invention the soaker drum is operated at increased pressure and temperature to reduce reaction time and therefore the soaker drum size.

In a preferred embodiment of the present invention, the particles of the short contact time reaction zone are fluidized and/or stirred with the aid of a mechanical means.

In another preferred embodiment of the present invention, steam, $C_4$ minus gas, or both, is injected into the vaporized fraction upstream of the soaker drum to reduce the partial pressure of the $C_5$ plus hydrocarbon to condense the high boiling fraction as per step (f) at a temperature which is lower than its initial boiling point of about 450–600° C.

In another preferred embodiment of the present invention polymerization initiators are present in the soaker drum to increase reaction rates.

In yet another preferred embodiment of the present invention the soaker drum can include a mechanical mixing device providing the advantages of self-cleaning to minimize coke deposits and to achieve substantially plug flow reaction conditions of the liquid phase.

BRIEF DESCRIPTION OF THE FIGURE

The sole FIGURE hereof is a schematic flow plan of a non-limiting preferred embodiment of the present invention.

DETAILED DESCRIPTION OF THE INVENTION

Residua feedstocks which are upgraded in accordance with the present invention are those petroleum fractions boiling above about 380° C., preferably above about 540° C., more preferably above about 560° C. Non-limiting examples of such fractions include vacuum resids, atmospheric resids, heavy and reduced petroleum crude oil; pitch; waste oils; asphalt; bitumen; solvent deasphalter residue; and tar sand oil. It is understood that such resids may also contain minor amounts of lower boiling material. These feedstocks cannot be fed in substantial quantities to refinery process units, such as FCC units, because they are typically high in Conradson Carbon and they usually contain an undesirable amount of metal-containing components. Conradson Carbon residues will deposit on the FCC cracking catalyst and cause excessive deactivation. Metals, such as nickel and vanadium will also deactivate the catalyst by acting as catalyst poisons. Such feeds will typically have a Conradson Carbon content of at least 5 wt. %, generally from about 5 to 50 wt. %. As to Conradson Carbon residue, see ASTM Test D189–165.

Residuum feedstocks are upgraded in accordance with the present invention in a short vapor residence time process unit which is comprised of a heating zone, a short vapor residence time horizontal fluidized and/or stirred bed reaction zone and a stripping zone. Reference is now made to the sole FIGURE hereof wherein a residual feedstock which is high in Conradson Carbon and/or metal-components is fed via line 10 to one or more short vapor residence time reaction zone 1 which contains a horizontal moving bed of fluidized and/or stirred hot solids. It is preferred that the solids in the short vapor residence time reactor are fluidized and/or stirred with assistance of mechanical means. The reactor may be stripped by use of a stripping gas, such as steam, or $C_4$ minus gas, or by the vapors resulting from the vaporization of a fraction of the feedstock. It is preferred that the mechanical means be a self cleaning mechanical mixing system characterized as having a relatively high radial mixing efficiency with only minor amounts of axial back-mixing. Such a mixing system acts like a plug flow system with a flow pattern which ensures that the residence time is nearly equal for all particles. The most preferred mechanical mixer is the mixer referred to by Lurgi AG of Germany as the LR-Mixer or LR-Flash Coker which was originally designed for processing oil shale, coal, and tar sands. The LR-Mixer consists of two or more horizontally oriented rotating screws which mix the feed and hot solids while stirring and transporting the mixture through the reactor. Although it is preferred that the solid particles be coke particles, they may be any other suitable refractory particulate material. Non-limiting examples of such other suitable refractory materials include those selected from the group consisting of silica, alumina, zirconia, magnesia, mullite, synthetically prepared or naturally occurring material such as pumice, clay, kieselguhr, diatomaceous earth, bauxite, and the like. It is within the scope of the present invention that the solids be inert or have catalytic properties. The solids will preferably have an average particle size of about 40 microns to 2,000 microns, more preferably from about 200 microns to about 1000 microns.

The feedstock is contacted with the hot solids at a temperature from about 450° C. to about 700° C., preferably from about 500° C. to 600° C., more preferably from about 520° C. to 600° C. When this happens, a substantial portion of the high Conradson Carbon and metal-containing components will deposit on the hot solid particles in the form of high molecular weight carbon and metal moieties. The remaining portion will be vaporized on contact with the hot solids. The residence time of vapor products in reaction zone 1 will be an effective amount of time so that substantial secondary cracking does not occur. This amount of time will typically be less than about 5 seconds, preferably less than about 2 seconds. The residence time of solids in the reaction zone will be from about 5 to 60 seconds, preferably from about 10 to 30 seconds. One novel aspect of the present invention is that the residence time of the solids and the residence time of the vapor products, in the reaction zone, are independently controlled. Most fluidized bed processes are designed so that the solids residence time, and the vapor residence time cannot be independently controlled, especially at relatively short vapor residence times. It is preferred that the short vapor residence time process unit be operated so that the ratio of solids to feed be from about 30 to 1 to 3 to 1, preferably about 5 to 1. It is to be understood that the precise ratio of solids to feed will primarily depend on the heat balance requirement of the short vapor residence time reaction zone and the temperature of the solids. Associating the oil to solids ratio with heat balance requirements is within the skill of those having ordinary skill in the art, and thus will not be elaborated herein any further. A minor amount of the feedstock will deposit on the solids in the form of combustible carbonaceous material. Metal components will also deposit on the solids. Consequently, the vaporized portion will be substantially lower in both Conradson Carbon and metals when compared to the original feed.

The vaporized fraction is passed via line 11 to soaker drum 2 which is maintained at effective conditions so that the highest boiling materials are condensed out. Typically these conditions will include controlled quenching of the vapor fraction just below the dewpoint. The condensate is maintained in the soaker drum for an effective amount of time and reaction severity to initiate polymerization to coke precursors. A quench stream can also be passed into soaker drum via line 21. The quench stream will typically be an oil stream ranging from naphtha ($C_5$/150° C.) to residuum stream (550° C.+). Preferred quench streams are fractionator bottoms having a boiling range of 300° C. to 700° C. Coke or polymerization initiators which include those selected from the group consisting of elemental sulfur, peroxides, and spent cracking catalysts can be added to the soaker drum via line 19. Steam, $C_4$ minus, air, or a mixture thereof, can also be used in the soaker drum to increase reaction rates, strip lower boiling components, and to keep the solids suspended in a slurry. In addition, the soaker drum may be continuously cleaned by mechanical means to minimize coke deposits.

The soaker drum is operated at effective temperatures and residence times to initiate coking reactions, but not to the extent that coke deposits significantly build-up in the soaker drum. Preferred conditions include temperatures from about 350° C. to about 520° C., preferably from about 400° C. to about 450° C. and residence times of from about 1 to 60 minutes, preferably from about 5 to 30 minutes, depending on the feed properties and desired feed decontamination rates. Proper use of the soaker drum will selectively condense only the highest boiling vapor products and produce a pre-polymerized heavy oil which is recycled to reaction zone 1 via line 9. This will result in an increased metals rejection rate from about 90% for once-through to 95% or greater with extinction recycle. Use of the soaker drum also enables increased rejection of other feed contaminants, such as Conradson Carbon, sulfur, and nitrogen. Thus, the resulting liquid product quality is substantially improved and of higher value as feed to refinery conversion processes.

The vapor fraction from soaker drum 2 is passed via line 14 to cyclone 20 where most of the entrained solids, or dust, are removed. The dedusted vapors are then passed to quench zone 13 via line 24 where the vapors are reduced to temperatures below which substantial thermal cracking occurs. This temperature will preferably be below about 450° C., more preferably below about 340° C. Solids, having carbonaceous material deposited thereon, are passed from reaction zone 1 via line 15 to the bed of solids 17 in stripper 3. The solids pass downwardly through the stripper and past a stripping zone at the bottom section where any remaining volatiles, or vaporizable material, are stripped from the solids with use of a stripping gas, preferably steam, introduced into the stripping zone via line 16. Stripped vapor products pass upwardly in stripper vessel 3 to quench zone 13 where a light product is removed overhead via line 28. The light product will typically be a 550° C. minus product stream. A 550° C. plus stream will also be collected from the quench zone via line 26. The stripped solids are passed via line 18 to heater 4 which contains a heating zone. The heating zone is operated in an oxidizing gas environment, preferably air, at an effective temperature. That is, at a temperature that will meet the heat requirements of the reaction zone. The heating zone will typically be operated at a temperature of about 40° C. to 200° C., preferably from about 50° C. to 175° C., more preferably from about 50° C. to 120° C. in excess of the operating temperature of reaction zone 1. It is understood that preheated air can be introduced into the heater. While some carbonaceous residue will be burned from the solids in the heating zone, it is preferred that only partial combustion take place so that the solids, after passing through the heater, will have value as a fuel.

Excess solids can be removed from the process unit via line 50. Flue gas is removed overhead from heater 4 via line 40. The flue gas is passed through a cyclone system 36, 39, and 38 to remove most solid fines. Dedusted flue gas will be passed to a co-boiler for waste heat recovery (not shown), scrubbed to remove contaminants and particulates, and passed to atmosphere. The hot inert solids are then recycled via lines 12 to thermal zone 1.

What is claimed is:

1. Process for deasphalting an asphalt-containing feedstock in a deasphalting process unit comprised of:

(i) a heating zone wherein solids containing carbonaceous deposits are received from a stripping zone and heated in the presence of a heating gas which may contain oxygen for partial combustion purposes;

(ii) a short vapor residence time reaction zone containing a horizontal moving bed of stirred hot solids recycled from the heating zone and feed, which reaction zone is operated at a temperature from about 450° C. to about 700° C. and operated under conditions such that the solids residence time and the vapor residence time are independently controlled, which vapor residence time is less than about 5 seconds, and which solids residence is from about 5 to about 60 seconds; and (iii) a stripping zone through which solids having carbonaceous deposits thereon are passed from the reaction zone and wherein lower boiling additional hydrocarbon and volatiles are recovered with a stripping gas; which process comprises:

(a) feeding the asphalt-containing feedstock to the short vapor residence time reaction zone wherein it contacts the fluidized and/or stirred hot solids thereby resulting in high Conradson Carbon components and metal-containing components being deposited onto said hot solids, and a vaporized fraction;

(b) separating the vaporized fraction from the solids; and (c) passing the solids to said stripping zone where they are contacted with a stripping gas, thereby removing volatile components therefrom;

(d) passing the stripped solids to a heating zone where they are heated to an effective temperature that will maintain the operating temperature of the reaction zone;

(e) recycling hot solids from the heating zone to the reaction zone where they are contacted with fresh feedstock;

(f) passing the vaporized fraction from step (b) above to a soaker drum where it is quenched to produce a vapor fraction boiling less than about 450–600° C.

and a high boiling fraction condensate having an initial boiling point in the range of about 450° C. to 600° C.

(g) providing sufficient residence time and reactor severity in the soaker drum to permit molecular weight growth reactions to occur;

(h) recycling said high boiling fraction to the short vapor residence time reaction zone; and (i) recovering the vapor fraction having a lower concentration of contaminants from step (h).

2. The process of claim 1 wherein the vapor residence time of the short vapor residence time reaction zone is less than about 2 seconds.

3. The process of claim 1 wherein the residua feedstock is selected from the group consisting of vacuum resids, atmospheric resids, heavy and reduced petroleum crude oil; pitch; waste oils; asphalt; bitumen; solvent desphalter residue, and tar sand oil.

4. The process of claim 3 wherein the residua feedstock is a vacuum resid.

5. The process of claim 2 wherein the solids residence time of the short vapor residence time reaction zone is from about 10 to 30 seconds.

6. The process of claim 1 wherein the particles of the short vapor contact time reaction zone are fluidized with the aid of a mechanical means.

7. The process of claim 1 wherein the particles of the short vapor contact time reaction zone are stirred with the aid of a mechanical means.

8. The process of claim 6 or claim 7 wherein the mechanical means are comprised of a set of horizontally disposed screws within the reactor.

9. The process of claim 1 wherein the soaker drum is operated at a temperature from about 350° C. to 520° C. and a residence time of about 1 to 60 minutes.

10. The process of claim 9 wherein the soaker drum is operated at a pressure from about 1 to 10 bar.

11. The process of claim 10 wherein the soaker drum is operated at a temperature of about 400° to 450° C. and a pressure of about 1 to 3 bar.

12. The process of claim 9 wherein polymerization initiators are added to the soaker drum to increase reaction rates.

13. The process of claim 12 wherein the polymerization initiators are selected from the group consisting of elemental sulfur, peroxides, spent catalyst, coke particles, and air.

14. The process of claim 1 wherein steam, $C_4$ minus, air, or mixtures thereof, is injected into the soaker drum to maintain the solids in slurry suspension and to strip out lower boiling products.

15. The process of claim 1 wherein the soaker drum can be a mechanical mixing device that is operated in plug flow mode and provides self cleaning to minimize coke deposits.

16. The process of claim 1 wherein steam, $C_4$ minus gas, or mixtures thereof, is added to the vaporized fraction from the short residence time reaction zone to reduce its partial pressure and allow condensation of a higher boiling fraction.

* * * * *